United States Patent [19]

Kalina et al.

[11] 3,985,519

[45] Oct. 12, 1976

[54] HYDROGASIFICATION PROCESS

[75] Inventors: Theodore Kalina, Morris Plains; Harry A. Marshall, Madison, both of N.J.

[73] Assignee: Exxon Research and Engineering Company, Linden, N.J.

[22] Filed: Sept. 27, 1974

[21] Appl. No.: 509,880

Related U.S. Application Data

[63] Continuation-in-part of Ser. No. 238,895, March 28, 1972, abandoned.

[52] U.S. Cl. ..... 48/202; 48/206; 48/210; 252/373

[51] Int. Cl.[2] ..... C10J 3/46; C10J 3/54

[58] Field of Search ..... 48/203, 202, 206, 210, 48/197 R; 201/31; 252/373

[56] References Cited

UNITED STATES PATENTS

| | | | |
|---|---|---|---|
| 2,113,774 | 4/1938 | Schmalfeldt | 48/202 |
| 2,543,795 | 3/1951 | Mayer et al. | 48/202 |
| 2,609,283 | 9/1952 | Kalbach | 48/197 R |
| 2,623,816 | 12/1952 | Kalbach | 48/197 R |
| 2,634,198 | 4/1953 | Kalbach | 48/197 R |
| 2,662,816 | 12/1953 | Kalbach | 48/202 |
| 2,687,950 | 8/1954 | Kalbach | 48/197 R |
| 2,694,623 | 11/1954 | Welty et al. | 48/202 X |
| 2,694,624 | 11/1954 | Sweetser | 48/197 R |
| 2,713,590 | 7/1955 | Palmer et al. | 48/206 X |
| 2,741,549 | 4/1956 | Russell | 48/206 X |
| 2,912,315 | 11/1959 | Haney | 48/214 |
| 2,955,988 | 10/1960 | Sebastian | 201/15 |
| 3,019,096 | 1/1962 | Milbourne | 48/213 |
| 3,347,647 | 10/1967 | Feldkirschner et al. | 48/197 R |
| 3,463,623 | 8/1969 | Forney et al. | 48/202 |
| 3,698,882 | 10/1972 | Garrett et al. | 48/210 |
| 3,715,195 | 2/1973 | Tassoney et al. | 48/202 |
| 3,736,233 | 5/1973 | Sass et al. | 48/210 |
| 3,746,522 | 7/1973 | Donath | 48/210 |
| 3,846,096 | 11/1974 | Mallan et al. | 48/202 |
| 3,847,566 | 11/1974 | Wilson | 48/202 |

OTHER PUBLICATIONS

Gasification by the Moving-Burden Technique, Rayner, Journal of Institute of Fuel, Mar. 1952.

*Primary Examiner*—S. Leon Bashore
*Assistant Examiner*—Peter F. Kratz
*Attorney, Agent, or Firm*—James E. Reed

[57] ABSTRACT

Subdivided carbonaceous feed solids containing volatilizable hydrocarbons are hydrogasified by heating the solids to at least minimum hydrogasification temperature while in dilute phase suspension in a gas containing molecular hydrogen and in contact with subdivided hot solids having a temperature greater than minimum hydrogasification temperature. The feed and hot solids are passed with the hydrogen-containing gas through a transfer line hydrogasification zone having a length which, for the velocity of the solids passage therethrough, limits the residence of the solids therein to the time necessary for devolatilization of the carbonaceous feed solids and for conversion of a predetermined minor proportion of the carbon of the feed solids to methane. Suitably from about one to about 50 mol percent of the carbon in the carbonaceous feed solids is converted to methane. Preferably the hydrogen-containing gas is a synthesis gas produced in a fluidized bed steam gasification reaction zone into which carbonaceous solids from the transfer line hydrogasification zone are charged after the separation therefrom of product gases containing methane.

24 Claims, 1 Drawing Figure

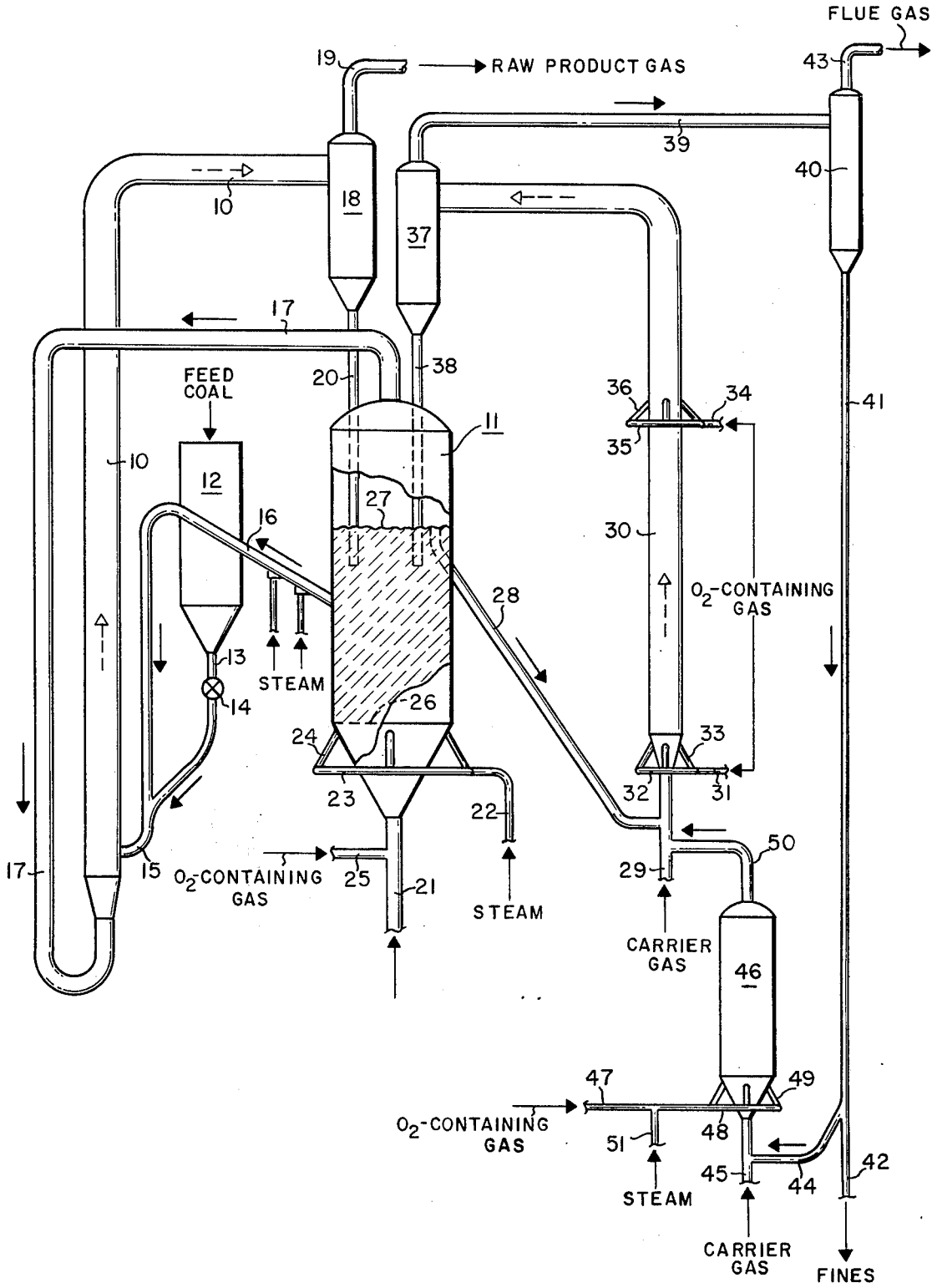
FLUE GAS
RAW PRODUCT GAS
FEED COAL
STEAM
$O_2$-CONTAINING GAS
CARRIER GAS
FINES

HYDROGASIFICATION PROCESS

CROSS-REFERENCE TO RELATED APPLICATIONS

This application is a continuation-in-part of application Ser. No. 238,895, filed in the U.S. Patent Office on Mar. 28, 1972 and now abandoned.

BACKGROUND OF THE INVENTION

1. Field of the Invention

This invention relates to processes for the production of methane from carbonaceous solids such as coal and is particularly concerned with gasification processes including a hydrogasification step in which hydrogen reacts with carbon to produce methane.

2. Description of the Prior Art

A serious decline in natural gas reserves has intensified efforts to develop processes for converting bituminous and lower rank coals into gas suitable for upgrading to high Btu synthetic natural gas. An important reaction in such processes is the strongly exothermic hydrogasification reaction: $C + 2H_2 \rightarrow CH_4$. To produce methane from carbonaceous material according to this reaction, a source of hydrogen is required. This hydrogen is generally produced by the highly endothermic steam gasification reaction: $C + H_2O \rightarrow CO + H_2$. The steam gasification reaction creates a large thermal demand that must be met in any coal gasification process.

Many of the hydrogasification schemes proposed heretofore have focused on the conversion of carbon to methane in a fluidized solids reactor. In such a system, synthesis gas including hydrogen and carbon monoxide is passed upwardly through a dense turbulent bed of finely divided carbonaceous solids. The main source of heat for heat up of the fluidized carbonaceous solids in the fluid bed reactors has been sensible heat from the upflowing synthesis gas. See, e.g., U.S. Pat. Nos. 2,543,795; 2,609,283; 2,623,816; 2,662,816; 2,687,950; 2,694,623; 2,694,624 and 3,194,644. Fluid bed reactors are large and expensive pieces of equipment, however, and generally require long solids residence or holdup times, typically a minimum of about 10 minutes.

One difficulty in using coal as the carbon source for fluidized bed hydrogasification reactions is that devolatilization of the coal, particularly if it is a caking coal, tends to cause agglomeration of the fluidized particles and may interfere with fluidization. One suggested solution to this problem is to dilute the coal feed by premixing it with a stream of char circulated from the hydrogasification fluid bed reactor prior to introducing the coal into that reactor. See. e.g., U.S. Pat. Nos. 2,662,816 and 2,687,950. More often, however, it is proposed that the coal be subjected to a low temperature carbonization with air or oxygen to devolatilize and preheat it. This is done, for example, in the Hygas process developed by the Institute of Gas Technology.

In other instances, it has been proposed that coal devolatilization prior to introduction of the coal into a fluid bed steam gasification zone is effected by contacting the coal, either concurrently or countercurrently, with hot gases. As an example of a countercurrent contacting process, the Bureau of Mines Synthane process described in U.S. Pat. No. 3,463,623 calls for subjecting the coal to a pretreatment with steam and oxygen in a free fall zone surmounting and in open communication with a fluidized bed in which gasification occurs. As an example of a concurrent contacting, the Bituminous Coal Research Bi-Gas process, also known as the "two-stage, superpressure entrained" process, contemplates the introduction of freshly pulverized coal into an upper section of a gasifier and entrainment of the coal in a rising stream of hot synthesis gas produced in a slagging zone in the lower section of the gasifier. Heated by the synthesis gas, the cola devolatilizes and the residual char is swept out of the gasifier, where it is separated from the gas and recycled to the lower section of the gasifier. A similar system is shown in U.S. Pat. No. 2,713,590, where the feed coal is introduced into a high velocity effluent stream from a stream gasification zone shortly before the stream enters a gas-solids separator in order to permit devolatilization at relatively low temperature. Another example of concurrent contacting for coal devolatilization appears in U.S. Pat. No. 2,634,198, in which finely divided coal particles are conveyed by a nonoxidizing recycle gas through a heat transfer tube in a steam gasification reactor. Still another example of concurrent contacting of gases and solids is the process shown in U.S. Pat. No. 2,955,988, in which finely divided coal particles are conveyed under laminar flow conditions through a low temperature carbonization zone by means of a mixture of steam and a recycle gas from the carbonization zone.

SUMMARY OF THE INVENTION

This invention provides an improved hydrogasification process in which feed solids containing devolatilizable hydrocarbons are rapidly heated up to at least minimum hydrogasification temperature in the presence of hot solid particles and a hydrogen-containing gas by passing the feed solids, hot solid particles and gas through a transfer line hydrogasification reaction zone designed to limit solids residence time to the time needed for devolatilization of the feed solids and for conversion of a predetermined minor proportion of the carbon in the carbonaceous feed solids to methane. At most, solids residence time is about 20 seconds. The rapid heat up is provided by contacting the feed solids in the hydrogasification zone with hot solids having a temperature greater than the minimum gasification temperature. Heat up, devolatilization and hydrogasification of the carbonaceous feed solids thus all take place in a dilute phase suspension of both feed solids and previously heated solid particles in a concurrent flow transfer line hydrogasification zone which limits solids residence time to only the time needed for devolatilization of the feed solids and for conversion to methane of a predetermined minor proportion between about 1 and about 50 mol percent of the carbon in the fresh carbonaceous feed solids.

In general, the process of the invention may be carried out continuously by suspending hot subdivided solids having a temperature greater than minimum hydrogasification temperature and subdivided carbonaceous feed solids containing volatilizable hydrocarbonaceous matter in dilute phase in a gaseous medium adapted to react with carbon in a hydrogasification reaction to produce methane, sufficient hot solids being suspended with the carbonaceous feed solids to heat up the feed solids in the gaseous medium to at least minimum hydrogasification temperature; passing the suspended solids in dilute phase in substantially concurrent flow with the gaseous medium through a transfer line hydrogasification zone of sufficient length, considering the velocity of the solids passing through the zone, to limit the residence time of the solids therein to only that needed for devolatilization of the carbonaceous feed solids and for conversion to methane of a predetermined minor portion of the carbon of the carbonaceous feed solids; and recovering at least part of the gaseous mixture issuing from the transfer line hydrogasification zone as a methane-enriched gas.

The residence time of the carbonaceous feed solids and of the hot solid particles in the transfer line hydrogasification zone will be with the range from about 1 to about 20 seconds, generally less than 15 seconds and, under preferred reaction conditions, less than 10 seconds. Depending on the reactivity of the particular carbonaceous feed solids, the outlet temperature of the transfer line hydrogasification zone, and the hydrogen partial pressure in the said zone, this short solids residence time will be adequate to accomplish a conversion to methane of as much as 50 mol percent of the carbon in the carbonaceous feed solids. Under the preferred operating conditions, the conversion of carbon in the carbonaceous feed solids to methane will range from about 5 to about 40 mol percent, typically from about 10 to about 25 mol percent. The product gas can readily be upgraded to a snythetic pipeline gas having a heating value of from about 900 to about 1000 Btu/SCF by using well-known shift, $CO_2$ and $H_2S$ removal, and catalytic methanation steps. Alternatively, this gas can be upgraded to a clean fuel gas having a heating value of from about 350 to about 500 Btu/SCF, typically by using only a $CO_2$ and $H_2S$ removal step.

Other hydrogasification conditions in the transfer line hydrogasification zone will normally include a hot solids inlet temperature of from about 1500° to about 2000° F. The carbonaceous feed solids inlet temperature may range from about 0° to about 500° F. Transfer line hydrogasification reactor outlet temperatures will generally be from about 1200° to about 1800° F., and outlet pressures will normally range from about 40 to about 1000 psia. The weight ratio of the hot solids to carbonaceous feed solids may be from about 3 to about 20 pounds per pound. Preferably the gaseous medium is introduced into the hydrogasifier at an inlet temperature of from about 1500° to about 2000° F. Superficial gas velocities in the hydrogasifier, measured at outlet temperature and pressure conditions, will range from about 20 to about 100 feet per second.

The preferred carbonaceous feed solid for the hydrogasification process of the invention is a bituminous, sub-bituminous, lignite or brown coal, although other essentially organic sources such as tar sands, shale oil, solidified petroleum heavy residuums or the like may be employed.

Any of a variety of subdivided solids having melting points in excess of the hydrogasification temperature may be used as the heat source for heating up the carbonaceous feed solids in the hydrogasifier. Suitable materials include sand, petroleum coke, coal char, ash particles, and the like. Solids having catalytic activity for the promotion of hydrogenation and hydrocracking reactions may be used if desired. Such catalysts include oxides of Group II metals, such as calcium, barium and strontium oxide, iron group type catalysts, synthetic zeolites, and carbon-alkali metal catalysts produced by impregnating coal, coke or other carbonaceous solids with a solution of potassium carbonate, cesium carbonate, potassium acetate, potassium sulfate or the like and heating the impregnated material to a temperature in the range of from about 800° to about 1400° F. or higher. In most cases, however, the use of char particles produced by the steam gasification of coal, coke or similar carbonaceous feed material is preferred.

The gaseous medium used to suspend the solids and hydrogasify the carbonaceous feed solids in the transfer line reaction zone may be pure molecular hydrogen but for reasons of economy of operation will preferably be a synthesis gas including hydrogen and carbon oxides produced by reacting carbon with steam under gasification conditions.

In a preferred embodiment of the invention, the transfer line hydrogasification rector is coupled with a fluidized bed steam gasification reactor for generating synthesis gas and subdivided coal feed solids are suspended in the synthesis gas with hot char solids withdrawn from the fluidized bed of the steam gasification reactor. The solids are transported in dilute phase through the transfer line hydrogasificatin zone by hot synthesis gas separately withdrawn from the steam gasification reactor. The fluidized bed steam gasification reactor is operated at a temperature in the range from about 1500° to about 2000° F. and a pressure in the range from about 50 to about 1000 psia. The char solids and the synthesis gas withdrawn from the fluidized bed reactor will thus have a temperature in the range from about 1500° to about 2000° F. Because the char solids from the fluidized bed reactor have more heat capacity than the synthesis gas, the feed coal solids transported through the transfer line hydrogasifier are heated principally by contact with the hot char moving concurrently through the reaction zone. The heated coal undergoes devolatilization and carbon in the coal reacts rapidly with hydrogen in the synthesis gas to produce methane. The produced gas is recovered from the transfer line hydrogasifier. The residual coal solids and the char solids are recovered from the gas and charged to the fluidized bed steam gasification reactor.

In the steam gasification reactor of the preferred embodiment, the solids are maintained in a dence turbulent fluidized bed by an upwardly flowing stream of saturated or superheated steam, alone or in combinatuion with other gaseous materials. This use of a fluidized bed is particularly advantageous, especially in continuous operations, because it provides larger solid reaction surfaces, better mixing, greatly improved temperature control and generally higher yields of hydrogen than can be obtained in fixed or gravitating bed operations. Furthermore, the use of a fluidized bed facilitates the handling of solids, permitting them to be treated in a manner analogous to that used for liquids and thus simplifying their withdrawal and transfer into the transfer line hydrogasification reactor.

The heat required to maintain the desired operating temperatures within the steam gasification fluidized bed reactor, generally between about 1500° and about 2000° F., may be supplied in any of several different ways. For example, sufficient quantities of an oxidizing gas may be supplied to the steam gasification reaction zone to generate by partial combustion within that zone the heat required by the steam gasification reaction to produce synthesis gas. Preferably, however, the necessary heat is supplied as sensible heat by burning solid carbonaceous gasification residues with air in separate combustion zone and circulating highly heated combustion residues from this combustion zone to the steam gasification reaction zone. This latter method has the advantage of avoiding dilution of the product gases with inert gases.

BRIEF DESCRIPTION OF THE DRAWING

The sole FIGURE in the drawing is a schematic flow diagram illustrating a coal gasification process carried out in accordance with the invention.

DESCRIPTION OF THE PREFERRED EMBODIMENT

In the system shown in the drawing, reference numeral 10 indicates a transfer line hydrogasification reactor and reference numeral 11 designates a fluidized bed synthesis gas generation vessel. In this system, feed coal of bituminous or lower rank, which may be at atmospheric temperature or may be preheated, is introduced into hopper 12 from a coal preparation plant or storage facility not shown in the drawing. The feed material is discharged from the hopper through line 13 containing star wheel feeder or similar metering device 14 into line 15 and thence into transfer line hydrogasification zone 10. As illustrated, the feed coal is introduced into zone 10 in admixture with hot char from line 16 but it will be understood that the hot char and feed coal may be separately introduced into the base of the transfer line hydrogasification zone 10 if desired. The feed coal is subdivided and will normally be ground and screened to a particle size of about 8 mesh or smaller.

The system shown is normally operated under superatmospheric pressure and may therefore include lock hoppers operated in parallel or other means in lieu of or in addition to the star wheel feeder 14 for feeding the coal into line 16 at the required pressure level. The coal may be fed into hopper 12, for example, at atmospheric pressure, undergo pressurization to the system pressure or a slightly higher pressure within the hiopper, and then be discharged through line 13 and feeder 14 into transfer line hydrogasification zone 10. This will normally entail the use of two or more pressurized hoppers. In lieu of this, the coal may be brought up to system pressure by means of a plurality of aerated stand pipes operated in series or the like.

The subdivided feed coal is fed into the base of transfer line hydrogasification zone 10 in combination with particulate char solids introduced through line 16 from a fluidized bed of char in synthesis gas generation zone 11. Here the subdivided coal solids and the char particles are suspended in synthesis gas withdrawn from synthesis gas generation zone 11 and introduced into the base of transfer line hydrogasification zone 10 through line 17.

The circulated hot char and hot synthesis gas provide heat to the transfer line hydrogasification zone, the char circulation rate-to-coal rate ratio being selected such that the circulated hot char serves as the principal source of heat in the transfer line reactor. The char circulation rate-to-coal feed rate ratio is preferably between about 3 and about 20 pounds per pound. The weight ratio of circulated hot char to feed coal is correlated with the rate of hot synthesis gas feed to provide an outlet temperature from the transfer line hydrogasification zone 10 between about 1200° and about 1800° F. In hydrogasifier 10, the feed coal is devolatilized and reactive carbon in the feed coal interacts with hydrogen in the synthesis gas to produce methane. The length of the transfer line hydrogasification zone 10 and the solids velocity through the zone are correlated to limit the solids residence in the zone to 20 seconds or less, preferably less than 10 seconds. Temperature and hydrogen partial pressure in the hydrogasifier are controlled so that up to about 50 mol percent, preferably up to about 40 mol percent, of the carbon of the feed coal is converted into methane. Carbon conversion levels up to about 25 mol percent are typical.

The suspended solids leaving the transfer line hydrogasifier 10 pass into a gas-solids separator 18 which will normally comprise one or more centrifugal separators or similar devices. In separator 18, the solids are removed from the gas stream withdrawn from the transfer line hydrogasifier. The raw product gas is taken overhead through line 19. The solids are conveyed from the separator through dip leg line 20 into the fluidized bed of char in synthesis gas generation zone 11, a steam gasification reactor. Carbonaceous material in reactor 11 is maintained in the fluidized state by controlling the superficial velocity of upflowing gases, normally saturated or superheated steam introduced into the bottom of the vessel through line 21 and through line 22, manifold 23 and nozzles 24. Alternatively, a mixture of steam with oxygen introduced through line 25 may be used. The injected steam or mixture of steam and oxygen reacts with the carbonaceous material to produce hydrogen and carbon oxides. The superficial gas velocities within the reactor will be between about 0.2 and about 2 feet per second. The reactor is provided with a screen, grid or similar gas distributing means 26 near its lower end to obtain good distribution of the gas entering the reaction zone and promote fluidization. Depending on the particular superficial gas velocity, the calculated velocity at the vessel inlet assuming no solids in the vessel, and the amount of carbonaceous material in the reaction zone, the bed will normally have an upper dense phase level as indicated by reference numeral 27 and above that level there will be a dilute phase suspension of solids in gas.

Heat for the endothermic steam char reaction which takes place in reactor 11 is preferably generated by withdrawing a portion of the char solids from the fluidized bed through line 28 and charging these solids with a carrier gas introduced through line 29 into a combustion zone, preferably a transfer line burner 30. The subdivided carbonaceous solids are suspended in dilute phase by an oxidizing gas, preferably air, fed to the base of transfer line burner 30 through line 31, manifold 32 and nozzles 33. Additional oxygen-containing gas may be introduced into the burner through line 34, manifold 35, and nozzles 36. The dilute suspension moves through the elongated transfer line burner at a rapid rate. The function of the burner is to burn a portion of the carbonaceous material and produce predominantly $CO_2$, thus generating substantially more heat than if large quantities of CO were produced in the combustion reaction. The combination gases and unburned char solids are withdrawn from the burner before there is an opportunity for substantial quantities of the $CO_2$ to be reduced to CO and hence the time element is an important feature of the technique.

The gas and entrained solids leaving the transfer line burner enter gas-solids separating zone 37 which will normally comprise one or more centrifugal separators in which the solids are separated from the combustion gases. The solids removed from the gas are conveyed through dip leg line 38 back to the fluidized bed of carbonaceous solids in the steam gasification reactor 11. Usually, all or a substantial portion of the ash in the feed coal is carried from the system by the combustion gases withdrawn through line 39, along with some char fines. The ash and char fines can be recovered from the flue gas by means of cyclone separator or similar separation device 40 and withdrawn from the system through lines 41 and 42 for heat recovery and disposal. Alternatively, the fines can be recovered and employed to provide additional heat for the system as described hereafter. If necessary to maintain ash balance, char may be purged directly from the fluidized bed reactor 11 through a char withdrawal line not shown in the drawing. The flue gas withdrawn through line 43 may be further treated to recover heat and remove pollutants prior to its discharge into the atmosphere.

Circulation rates between the burner and the fluidized bed reactor are set at sufficiently high rates to support the endothermic reaction occurring in the fluidized bed reactor. The amount of hot solids fed to the fluidized bed reactor from the burner will depend on the degree of steam conversion and the carbonaceous solids residence time in the fluidized bed reactor. Typically, conditions are adjusted so that the exit temperature of solids from the transfer line burner 30 is about 50° to about 300° F., preferably about 200° F., higher than the temperature prevailing in the fluidized bed steam gasification reactor.

Lines 16 and 28 will normally be provided with gas taps not shown in the drawing through which steam or other fluidizing gas may be introduced for the purpose of effecting smooth flow of the solids through the lines.

In selecting operating conditions for the fluidized bed steam gasification reactor 11 and for the transfer line hydrogasifier 10, several factors, such as feed coal rank, desired delivery pressure of the product gas, and various economic factors often come into consideration. In general, at a given pressure, temperature, and steam rate in the fluidized bed reactor 11, carbonaceous residues from coals of higher rank require greater char solids holdup times in order to achieve the same gasification rate. In order to keep steam rate and reactor solids holdup within economical ranges, fluid bed reactor pressure and temperature, particularly the latter, are typically higher for higher rank feed coals.

The transfer line hydrogasification conditions required to obtain a desired conversion to methane may influence the selection of fluid bed reactor conditions. Transfer line hydrogasifier conditions are typically selected to promote high methane yields by coal devolatilization and the hydrogasification reaction, particularly when high Btu synthetic pipeline gas is the desired final product. In general, higher hydrogen partial pressures and higher temperatures in the transfer line hydrogasifier reduce the solids residence times needed to produce good yields of methane from a given coal feed. Higher rank coals typically require more severe reaction conditions to attain high methane yields.

Since the synthesis gas effluent from the fluidized bed reactor flows directly to the base of the transfer line hydrogasifier, the pressures in the two vessels are similar. Likewise, the hydrogen partial pressure in the transfer line hydrogasifier is determined by the hydrogen content of the synthesis gas effluent from the fluid bed reactor. The hydrogen partial pressure in the transfer line hydrogasifier can thus be increased by increasing the total pressure or the steam conversion in the fluidized bed reactor, the latter being related to solids residence time and other conditions in the fluidized bed. Desired final product gas delivery pressure may play a role in determining the fluidized bed reactor operating pressure, although a compression or expansion step will often be included in the gas upgrading train downstream of the transfer line hydrogasifier.

The major source of heat input to the transfer line hydrogasifier is the circulating char stream from the fluidized bed reactor. The transfer line hydrogasifier operating temperature can therefore be increased by increasing the char circulation rate or the fluidized bed reactor temperature. An upper limit to the range of suitable temperatures for the fluidized bed gasifier will usually be set to allow a predetermined temperature increase between the fluidized bed reactor and the outlet of the transfer line burner. Typically this is about 150° to 300° F. in order to keep char circulation rate to the transfer line burner within reasonable limits without closely approaching the ash fusion temperature of the coal at the outlet of the transfer line burner.

These and other various technical and economic factors must be weighed against methane yield credits in selecting operating conditions for the transfer line hydrogasifier. Typically, there are economic debits associated with increasing the fluidized bed reactor pressure, temperature, or steam rate, and these variables are also subject to other limitations as previously discussed. Particularly important is the temperature limit imposed on the fluidized bed reactor by the need to avoid ash fusion in the transfer line burner. A minimum char circulation rate to the transfer line hydrogasifier is required to provide the requisite heat to the feed coal. High char circulation rates incur economic debits, and may lead to control and operability problems. The transfer line hydrogasifier residence time must be adequate to allow devolatilization and the rapid hydrogasification reaction to proceed nearly to completion under the selected conditions. Physical constraints on transfer line hydrogasifier configuration limit the maximum residence time to about 20 seconds.

Operating conditions in the fluidized bed reactor and the transfer line hydrogasifier for a system in which heat for the endothermic steam gasification reaction and for the heat up of feed coal is provided by combustion of char circulated through a transfer line burner, as described, are shown below in Table I.

TABLE I

OPERATING CONDITIONS IN FLUID BED REACTOR AND TRANSFER LINE HYDROGASIFIER FOR COAL FEEDS

| Item | Broad Range (All Coals) | Preferred Range (Bituminous Coals) | Example (Bituminous Coal) |
|---|---|---|---|
| Fluidized Bed Reactor | | | |
| Temperature, °F | 1500–1900 | 1650–1800 | 1750 |
| Pressure, psia | 50–1000 | 100–600 | 535 |
| Steam Rate/Coal Feed Rate, lbs/lb | 0.3–1.5 | 0.5–1.2 | 0.85 |
| Steam Superficial Velocity[1], ft/sec | 0.2–2.0 | 0.3–1.5 | 0.6 |
| Char Solids Holdup in Bed/Coal Feed Rate, hrs. | 0.2–5.0 | 0.5–3.0 | 1.1 |

TABLE I-continued

| OPERATING CONDITIONS IN FLUID BED REACTOR AND TRANSFER LINE HYDROGASIFIER FOR COAL FEEDS | | | |
|---|---|---|---|
| Item | Broad Range (All Coals) | Preferred Range (Bituminous Coals) | Example (Bituminous Coal) |
| Syn Gas Effluent Rate/Coal Feed Rate, SCF/lb | 10–40 | 15–35 | 24.4 |
| Syn Gas Effluent Composition, mole % | | | |
| $CH_4$ | 0–15 | 0.10 | 5.1 |
| CO | 10–35 | 10–35 | 17.5 |
| $CO_2$ | 5–25 | 5–25 | 11.5 |
| $H_2$ | 20–40 | 20–40 | 32.5 |
| $H_2O$ | 20–45 | 20–40 | 33.2 |
| Other | 0–2 | 0–2 | 0.2 |
| Transfer Line Hydrogasifier | | | |
| Char Solids Inlet Temperature, °F | 1500–1900 | 1650–1800 | 1750 |
| Syn Gas Inlet Temperature, °F. | 1500–1900 | 1650–1800 | 1750 |
| Coal Feed Inlet Temperature, °F. | 0–500 | 50–400 | 100 |
| Outlet Temperature, °F. | 1200–1800 | 1550–1750 | 1600 |
| Outlet Pressure, psia | 40–1000 | 90–600 | 530 |
| Char Circulation Rate/Coal Feed Rate, lbs/lb | 3–20 | 5–15 | 6.3 |
| Solids Residence Time, sec. | 1–20 | 3–15 | 7.5 |
| Gas Superficial Velocity[2], ft/sec | 20–100 | 20–50 | 30 |
| Product Gas Rate/Coal Feed Rate, SCF/lb | 15–45 | 20–40 | 30.5 |
| Product Gas Composition, mol % | | | |
| $CH_4$ | 1–25 | 5–20 | 13.9 |
| CO | 10–35 | 10–35 | 14.9 |
| $CO_2$ | 5–25 | 5–25 | 11.9 |
| $H_2$ | 15–40 | 15–40 | 27.2 |
| $H_2O$ | 15–45 | 14–40 | 28.8 |
| $C_2$+ Hydrocarbons | 0–10 | 0–5 | 1.6 |
| Other | 0–3 | 0–3 | 1.7 |

Notes:
[1]At fluidized bed temperature and pressure.
[2]At outlet temperature and pressure.

In using a transfer line burner to provide heat for the steam gasification reaction and for solid carbonaceous feed heat, up continued recirculation of char in the transfer line burner may in some cases produce large quantities of excessively small char fines less than about 44 microns in size. These fines are difficult to recover from effluent gases by conventional gas-solid separators such as staged centrifugal separators. One embodiment of this invention therefore contemplates the collection of fines from the gas-solid separator before they become excessively small and the use of such fines in one of two alternative processes to provide heat for the system.

In one approach, at least part of the char fines withdrawn through line 41 are passed through line 44, entrained by recycle flue gas, steam or other carrier gas introduced through line 45, and carried into combustion zone 46 where they are contacted with a gas containing oxygen in excess of stoichiometric requirements for complete combustion of the fines. The oxygen-containing gas is introduced through line 47, manifold 48, and nozzles 49. Under the combustion conditions existing in the combustion zone, the fines are substantially burned to completion to produce a hot oxidizing gas containing from about 5 to about 20 mol percent molecular oxygen. The oxidizing gas is passed through lines 50 and 29 into the transfer line burner described above to suspend and convey the char circulated from the fluidized bed through the burner. There a portion of the char is burned to heat the remaining char to predetermined levels short of ash fusion temperature but higher than temperatures in the steam gasification reactor. Additional oxygen-containing gas may be introduced through lines 31 and 34 if desired but this is not essential. At the outlet of the transfer line burner, the hot unburned solids are separated from the flue gases in one or more cyclones and the larger hot solids are returned to the fluid bed reactor.

In the second alternative method for treating char fines, the char fines introduced into combustion zone 46 are contacted with a mixture of oxygen-containing gas introduced through line 47 and steam introduced through line 51. The steam is mixed with the oxygen-containing gas in quantities sufficient to limit the combustion temperature in the combustion zone to below about 2100° F., thereby producing an effluent containing heated char fines and a producer gas which contains hydrogen and carbon monoxide. The producer gas effluent from the combustion zone, which in this embodiment serves as a partial oxidation zone, and the hot char fines therein are fed through lines 50 and 29 to the base of the transfer line burner. Makeup oxidizing gas to aid in suspending and conveying the char from the fluidized bed through the transfer line burner and to heat the char circulated therethrough to a temperature which is hotter than the temperature of the fluid bed by a predetermined amount is added through line 31, manifold 32, and nozzles 33, or through line 34, manifold 35 and nozzles 36. At the outlet of the transfer line burner, the hot char solids are separated from the hot gases in a gas-solid separation zone as hereinbefore described and the larger hot char solids are returned to the fluid bed. The fines can thus be used to supply the heat for the steam gasification process and for heating the coal feed.

In the excess oxygen case, the char fines combustion temperature is kept below about 2100° F. to avoid coal ash fusion by using excess combustion gas, preferably air. Residence time in the combustion zone is short, since the combustion reaction is rapid. This case is limited in the maximum amount of char fines which can be handled because the amount of air fed cannot exceed the total transfer line burner air requirement. In the partial oxidization case, the char fines combustion temperature is kept below about 2100° F. by injecting steam along with insufficient combustion gas, preferably air. The steam and some $CO_2$ produced in combustion gasify excess carbon in the char fines to make CO. These endothermic gasification reactions act to moderate the combustion temperature. Somewhat longer residence times are required in the combustion zone to permit the gasification reactions to proceed. The partial oxidation approach can handle char fines rates which are too large for the excess air case.

The range of operating conditions which may be used in these three systems for burning a portion of the carbonaceous solids from the fluidized bed outside the fluidized bed are set forth in Table II.

TABLE II

OPERATING CONDITIONS IN TRANSFER LINE BURNER CONFIGURATIONS FOR COAL FEEDS

| Item | Broad Range (All Coals) | Preferred Range (Bituminous Coals) | Example (Bituminous Coal) |
|---|---|---|---|
| Transfer Line Burner, Base Case | | | |
| Char Solids Inlet Temperature, °F | 1500–1900 | 1650–1800 | 1750 |
| Outlet Temperature, °F | 1650–2100 | 1800–2050 | 1950 |
| Outlet Pressure, psia | 50–1000 | 100–600 | 535 |
| Char Circulation Rate/Coal Feed Rate, lbs/lb | 5–40 | 10–35 | 21.7 |
| Air Rate[2]/Char Circulation Rate, lbs/lb | 0.04–0.40 | 0.05–0.30 | 0.101 |
| Solids Residence Time, sec | 0.3–5.0 | 0.5–3.0 | 1.0 |
| Gas Superficial Velocity[1], ft/sec | 20–100 | 30–100 | 45 |
| Flue Gas Rate/Coal Feed Rate, SCF/lb | 15–50 | 20–45 | 29.2 |
| Flue Gas Composition, mole % | | | |
| CO | 0–20 | 0–15 | 1.9 |
| $CO_2$ | 5–25 | 10–25 | 19.0 |
| $H_2O$ | 0–10 | 0–5 | 1.4 |
| $O_2$ | 0–2 | Nil | Nil |
| $N_2$ | 65–80 | 70–80 | 76.8 |
| Other | 0–3 | 0–2 | 0.9 |
| Transfer Line Burner, Separate Combustion of Char Fines with Excess Air | | | |
| A. Separate Combustion Zone: | | | |
| Outlet Temperature, °F | 1000–2100 | 1500–2050 | — |
| Outlet Pressure, psia | 50–1000 | 100–600 | — |
| Char Fines Rate/Coal Feed Rate, lbs/lb | 0.01–0.50 | 0.03–0.30 | — |
| Air Rate[2]/Char Fines Rate, lbs/lb | 3–50 | 5–35 | — |
| Char Fines Residence Time, sec | 0.3–5.0 | 0.5–3.0 | |
| Effluent Gas Rate/Coal Feed Rate, SCF/lb | 15–50 | 20–45 | — |
| Effluent Gas Composition, mole % | | | |
| CO | 0–5 | 0–2 | — |
| $CO_2$ | 2–15 | 3–15 | — |
| $H_2O$ | 0–5 | 0–3 | — |
| $O_2$ | 5–20 | 5–18 | — |
| $N_2$ | 70–80 | 70–80 | — |
| Other | 0–3 | 0–2 | — |
| B. Transfer Line Burner: | | | |
| Char Solids Inlet Temperature, °F | 1500–1900 | 1650–1800 | — |
| Outlet Temperature, °F | 1650–2100 | 1800–2050 | — |
| Outlet Pressure, psia | 50–1000 | 100–600 | — |
| Char Circulation Rate/Coal Feed Rate, lbs/lb | 5–40 | 10–35 | — |
| Rate, lbs/lb | 5–40 | 10–35 | — |
| Combustion Zone Effluent Gas Rate/Char Circulation Rate, lbs/lb | 0.04–0.45 | 0.05–0.35 | — |
| Solids Residence Time, sec | 0.3–5.0 | 0.5–3.0 | — |
| Gas Superficial Velocity[1], ft/sec | 20–100 | 30–100 | — |
| Flue Gas Rate/Coal Feed Rate, SCF/lb | 15–50 | 20–45 | — |
| Flue Gas Composition, mole % | | | |
| CO | 0–20 | 0–15 | — |
| $CO_2$ | 5–25 | 10–25 | — |
| $H_2O$ | 0–10 | 0–5 | — |
| $O_2$ | 0–2 | Nil | — |
| $N_2$ | 65–80 | 70–80 | — |
| Other | 0–3 | 0–2 | — |
| Transfer Line Burner, Separate Combustion of Char Fines with Insufficient Air | | | |
| A. separate Combustion Zone: | | | |
| Outlet Temperature, °F | 1650–2100 | 1800–2050 | — |
| Outlet Pressure, psia | 50–1000 | 100–600 | — |
| Char Fines Rate/Coal Feed Rate, lbs/lb | 0.01–1.00 | 0.10–0.60 | — |
| Air Rate[2]/Char Fines Rate, lbs/lb | 0.1–10.0 | 0.5–5.0 | — |
| Steam Rate/Char Fines Rate, lbs/lb | 0–2.0 | 0–1.0 | — |
| Char Fines Residence Time, sec | 1–20 | 2–10 | — |
| Effluent Gas Rate/Coal Feed Rate, SCF/lb | 1–35 | 2–30 | — |
| Effluent Gas Composition, mole % | | | |
| CO | 5–40 | 10–30 | — |
| $CO_2$ | 5–25 | 5–20 | — |
| $H_2$ | 0–25 | 0–20 | — |
| $H_2O$ | 0–30 | 0–25 | — |
| $O_2$ | 0–1 | Nil | — |
| $N_2$ | 30–80 | 40–80 | — |
| Other | 0–3 | 0–2 | — |
| B. Transfer Line Burner: | | | |
| Char Solids Inlet Temperature, °F | 1500–1900 | 1650–1800 | — |
| Outlet Temperature, °F | 1650–2100 | 1800–2050 | — |

TABLE II-continued

OPERATING CONDITIONS IN TRANSFER LINE BURNER CONFIGURATIONS FOR COAL FEEDS

| Item | Broad Range (All Coals) | Preferred Range (Bituminous Coals) | Example (Bituminous Coal) |
|---|---|---|---|
| Outlet Pressure, psia | 50–1000 | 100–600 | — |
| Char Circulation Rate/Coal Feed Rate, lbs/lb | 5–40 | 10–35 | — |
| Combustion Zone Effluent Gas Rate/Char Circulation Rate, lbs/lb | 0.01–0.35 | 0.01–0.25 | — |
| Supplemental Air Rate[2]/Char Circulation Rate, lbs/lb | 0.01–0.35 | 0.02–0.25 | — |
| Solids Residence Time, sec | 0.3–5.0 | 0.5–3.0 | — |
| Gas Superficial Velocity[1], ft/sec | 20–100 | 30–100 | — |
| Flue Gas Rate/Coal Feed Rate, SCF/lb | 15–60 | 20–50 | — |
| Flue Gas Composition, mole % | | | |
| CO | 0–20 | 0–15 | — |
| $CO_2$ | 5–25 | 10–25 | — |
| $H_2O$ | 0–30 | 0–20 | — |
| $O_2$ | 0–2 | Nil | — |
| $N_2$ | 50–80 | 55–80 | — |
| Other | 0–3 | 0–2 | — |

Notes:
[1]At Transfer Line Burner outlet temperature and pressure.
[2]An oxygen-containing gas may be substituted for air. Approximately the same amount of contained oxygen must be fed as with air. Flue gas rate and composition will differ according to the composition of the oxygen-containing gas.

As mentioned, the heat required to maintain the desired temperature in the endothermic steam gasification reactor alternatively may be provided by supplying an oxidizing gas to the steam gasification reactor through line 25 to generate by partial combustion within that reactor the heat required by the steam gasification reaction. In this form of the invention, the transfer line burner is not required. Thus, control difficulties, excessive fines production, and other problems which may in some cases be associated with certain applications of the transfer line burner are avoided. The special advantages associated with the use of the transfer line hydrogasifier are retained.

Typically, the oxidizing gas employed in the fluidized bed reactor may be either "pure" oxygen or air. The preferred operating conditions for the reactor and transfer line hydrogasifier when such a gas is used are for the most part similar to those previously set forth for the base form of the invention in Table I. The fluidized bed temperature can be higher with direct oxidizing gas addition because this is now the maximum temperature in the system. The volumes of synthesis gas and product gas per pound of coal feed are greater because carbon oxides from combustion reactions, and nitrogen if air is used, are mixed with the products of the devolatilazation and steam gasification reactions. If the oxygen-containing gas is pure oxygen, the gaseous product typically contains from about 5 to about 20 mol percent of methane. This gas can be upgraded to a synthetic pipeline gas having a heating value of from about 900 to about 1000 Btu/SCF or to a clean fuel gas having a heating value of from about 350 to about 500 Btu/SCF. If the oxygen-containing gas is air, the gaseous product typically contains from about 2 to about 15 mol percent of methane. This gas can be upgraded to a clean, low Btu fuel gas having a heating value of from about 150 to about 250 Btu/SCF, typically using an $H_2S$ and $CO_2$ removal step.

Suitable operating conditions in the fluid bed reactor and in the transfler line hydrogasifier when the oxidizing gas is pure oxygen are set forth in Table III below.

TABLE III

OPERATING CONDITIONS IN FLUIDIZED BED REACTOR AND TRANSFER LINE HYDROGASIFIER FOR COAL FEEDS USING DIRECT OXYGEN ADDITION TO FLUIDIZED BED REACTOR

| Item | Broad Range (All Coals) | Preferred Range (Bituminous Coals) | Example (Bituminous Coal) |
|---|---|---|---|
| Fluidized Bed Reactor | | | |
| Temperature, °F | 1500–2000 | 1700–1900 | 1750 |
| Pressure, psia | 50–1000 | 100–1000 | 535 |
| Steam Rate/Coal Feed Rate, lbs/lb | 0.3–1.5 | 0.50–1.20 | 0.83 |
| Oxygen Rate/Coal Feed Rate, lbs/lb | 0.2–0.8 | 0.25–0.60 | 0.38 |
| Steam-Oxygen Superficial Velocity[1], ft/sec | 0.2–2.0 | 0.3–1.5 | 0.6 |
| Char Solids Holdup in Bed/Coal Feed Rate, hrs | 0.2–5.0 | 0.3–3.0 | 1.3 |
| Syn Gas Effluent Rate/Coal Feed Rate SCF/lb | 15–45 | 20–40 | 30.9 |
| Syn Gas Effluent Composition, mole % | | | |
| $CH_4$ | 0–15 | 0–10 | 3.6 |
| CO | 15–45 | 15–45 | 27.1 |
| $CO_2$ | 10–35 | 10–35 | 16.5 |
| $H_2$ | 15–35 | 15–35 | 27.1 |
| $H_2O$ | 15–40 | 15–35 | 25.5 |
| Other | 0–2 | 0–2 | 0.2 |
| Transfer Line Hydrogasifier | | | |
| Char Solids Inlet Temperature, °F | 1500–2000 | 1700–1900 | 1750 |
| Syn Gas Inlet Temperature, °F | 1500–2000 | 1700–1900 | 1750 |
| Coal Feed Inlet Temperature, °F | 0–500 | 50–400 | 100 |
| Outlet Temperature, °F | 1200–1800 | 1550–1750 | 1600 |

TABLE III-continued

OPERATING CONDITIONS IN FLUIDIZED BED REACTOR AND TRANSFER LINE HYDROGASIFIER FOR COAL FEEDS USING DIRECT OXYGEN ADDITION TO FLUIDIZED BED REACTOR

| Item | Broad Range (All Coals) | Preferred Range (Bituminous Coals) | Example (Bituminous Coal) |
|---|---|---|---|
| Outlet Pressure, °F | 40–1000 | 90–1000 | 530 |
| Char Circulation Rate/Coal Feed Rate, lbs/lb | 3–20 | 5–15 | 6.1 |
| Solids Residence Time, sec | 1–20 | 3–15 | 7.5 |
| Gas Superficial Velocity[2], ft/sec | 20–100 | 20–50 | 30 |
| Product Gas Rate/Coal Feed Rate, SCF/lb | 20–55 | 25–50 | 37.2 |
| Product Gas Composition, mole % | | | |
| $CH_4$ | 1–25 | 5–20 | 10.5 |
| CO | 15–40 | 15–40 | 23.1 |
| $CO_2$ | 10–35 | 10–35 | 16.2 |
| $H_2$ | 15–35 | 15–35 | 24.6 |
| $H_2O$ | 10–40 | 10–35 | 22.8 |
| $C_2$ + Hydrocarbons | 0–10 | 0–5 | 1.3 |
| Other | 0–3 | 0–3 | 1.5 |

Notes:
[1]At fluidized bed temperature and pressure.
[2]At outlet temperature and pressure.

Suitable conditions for the fluidized bed reactor and the transfer line hydrogasifier when the oxidizing gas injected into the steam gasification reaction zone is air are set forth in Table IV below.

TABLE IV

OPERATING CONDITIONS IN FLUIDIZED BED REACTOR AND TRANSFER LINE HYDROGASIFIER FOR COAL FEEDS USING DIRECT AIR ADDITION TO FLUIDIZED BED REACTOR

| Item | Broad Range (All Coals) | Preferred Range (Bituminous Coals) | ExaMPLE (Bituminous Coal) |
|---|---|---|---|
| Fluidized Bed Reactor | | | |
| Temperature, °F | 1500–2000 | 1700–1900 | 1750 |
| Pressure, psia | 50–1000 | 100–600 | 180 |
| Steam Rate/Coal Feed Rate, lbs/lb | 0.3–1.5 | 0.5–1.2 | 0.84 |
| Air Rate/Coal Feed Rate, lbs/lb | 1.0–5.0 | 1.5–3.5 | 2.44 |
| Steam-Air Superficial Velocity[1], ft/sec | 0.3–3.0 | 0.5–2.0 | 1.2 |
| Char Solids Holdup in Bed/Coal Feed Rate, hrs | 0.2–5.0 | 0.5–4.0 | 1.9 |
| Syn Gas Effluent Rate/Coal Feed Rate, SCF/lb | 35–75 | 40–70 | 57.2 |
| Syn Gas Effluent Composition, mole % | | | |
| $CH_4$ | 0–10 | 0–5 | 1.8 |
| CO | 5–25 | 5–25 | 11.9 |
| $CO_2$ | 5–25 | 5–25 | 12.2 |
| $H_2$ | 5–25 | 5–25 | 11.6 |
| $H_2O$ | 5–35 | 10–30 | 18.3 |
| $N_2$ | 25–65 | 30–60 | 43.6 |
| Other | 0–2 | 0–2 | 0.6 |
| Transfer Line Hydrogasifier | | | |
| Char Solids Inlet Temperature, °F | 1500–2000 | 1700–1900 | 1750 |
| Syn Gas Inlet Temperature, °F | 1500–2000 | 1700–1900 | 1750 |
| Coal Feed Inlet Temperature, °F | 0–500 | 50–400 | 100 |
| Outlet Temperature, °F | 1200–1800 | 1550–1750 | 1600 |
| Outlet Pressure, psia | 40–1000 | 90–600 | 175 |
| Char Circulation Rate/Coal Feed Rate, lb/lbs | 3–20 | 5–15 | 9.3 |
| Solids Residence Time, sec | 1–20 | 3–15 | 7.5 |
| Gas Superficial Velocity[2], ft/sec | 20–100 | 20–50 | 30 |
| Product Gas Rate/Coal Feed Rate, SCF/lb | 45–85 | 50–80 | 64.0 |
| Product Gas Composition, mole % | | | |
| $CH_4$ | 1–20 | 2–15 | 4.1 |
| CO | 5–25 | 5–25 | 11.8 |
| $CO_2$ | 5–25 | 5–25 | 11.6 |
| $H_2$ | 5–25 | 5–25 | 13.6 |
| $H_2O$ | 5–35 | 10–30 | 17.7 |
| $N_2$ | 25–65 | 30–60 | 39.2 |
| $C_2$ + Hydrocarbons | 0–5 | 0–3 | 0.9 |
| Other | 0–3 | 0–3 | 1.1 |

Notes:
[1]At fluidized bed temperature and pressure.
[2]At outlet temperature and pressure.

The various embodiments of the invention are further illustrated by the following examples.

EXAMPLE 1

This example summarizes a calculated material balance for the integrated hydrogasification process illustrated in the drawing. In this example, the process conditions are those set forth in the example column of Table I for the base transfer line burner case of Table II. In this example, the feed is 2000 pounds per hour of bituminous coal. The ultimate analysis of the coal feed is:

| | lbs/hr |
|---|---|
| Carbon | 1,346 |
| Hydrogen | 94 |
| Oxygen | 121 |
| Nitrogen | 23 |
| Sulfur | 78 |
| Ash | 222 |
| Water | 116 |
| Total | 2,000 |

Char is withdrawn from the fluidized bed reactor at the rate of 12,600 pounds per hour and introduced with the feed coal into the base of the transfer line hydrogasifier 10, where it is suspended and entrained by 2,248 pounds per hour of synthesis gas from fluidized bed reactor 11. The steam rate to the fluidized bed reactor is 1,708 pounds per hour. The composition of the synthesis gas produced is shown in Table I. The mass analysis of the synthesis gas is as follows:

| | lbs./hr |
|---|---|
| $CH_4$ | 106 |
| CO | 629 |
| $CO_2$ | 653 |
| $H_2$ | 84 |
| $H_2O$ | 769 |
| Other | 7 |
| Total | 2,248 |

The effluent from the transfer line hydrogasifier 10 is passed to the gas-solid separation zone 18 where 13,804 pounds per hour of char are recovered and returned to fluidized bed reactor 11. The product gas is recovered at the rate of 3044 pounds per hour from the separation zone 18 and has the composition shown in Table I and mass proportions which follow:

| | lbs/hr |
|---|---|
| $CH_4$ | 357 |
| CO | 670 |
| $CO_2$ | 842 |
| $H_2$ | 88 |
| $H_2O$ | 834 |
| $C_2$+ | 164 |
| Other | 89 |
| Total | 3,044 |

The product gas is therefore recovered at the rate of 1.463 million standard cubic feet per day and has a heating value of 333 Btu's per standard cubic foot.

The heat for the fluidized bed reactor is generated by withdrawing 43,400 pounds per hour of char and burning it with 4,383 pounds per hour of feed air. The mass composition of feed air is 1,016 pounds per hour oxygen, 3,309 pounds per hour nitrogen and 58 pound of other constituents.

The flue gases and fines are separated from the char solids in a gas-solid separation zone, and 42,736 pounds per hour of char are returned to the fluidized bed reactor, while 5,047 pounds per hour of flue gas and fines are withdrawn for use as desired. The composition of the flue gas and fines is set out below:

| | lbs/hr |
|---|---|
| CO | 81 |
| $CO_2$ | 1,286 |
| $H_2O$ | 40 |
| $N_2$ | 3,309 |
| Other | 58 |
| Char Fines | 51 |
| Ash Fines | 222 |
| Total | 5,047 |

EXAMPLE 2

This example summarizes a calculated material balance for an integrated hydrogasification process for bituminous coal feed in which oxygen is directly added to the fluid bed steam gasification reactor. The feed rate and ultimate analysis of the coal feed are the same as in Example 1. Process conditions are set forth in the example column in Table III above.

The bituminous feed coal is fed at the rate of 2,000 pounds per hour into the base of transfer line hydrogasifier 11, which also receives 12,200 pounds per hour of char withdrawn from fluidized bed reactor 11. The feed coal and char are entrained and conveyed through transfer line hydrogasifier 10 by synthesis gas recovered at the rate of 3,361 pounds per hour from fluidized bed reactor 11. The mass analysis of the synthesis gas is as follows:

| | lbs/hr |
|---|---|
| $CH_4$ | 93 |
| CO | 1,237 |
| $CO_2$ | 1,182 |
| $H_2$ | 89 |
| $H_2O$ | 749 |
| Other | 11 |
| Total | 3,361 |

The steam feed rate and oxygen feed rate to fluidized bed reactor 11 are respectively 1,663 pounds per hour and 757 pounds per hour. The feed oxygen includes 3 pounds per hour of nitrogen. The entrained solids and the gaseous product mixture are recovered from transfer line hydrogasifier 10 and separated in the gas-solid separation zone. Char solids are recovered at the rate of 13,141 pounds per hour and returned to the fluidized bed reactor, while product gases and fines are recovered at the rate of 4,420 pounds per hour. This provides 1.783 million standard cubic feet per day of gaseous product having a heating value of 307 Btu's per standard cubic foot. The composition of the effluent from the separator is as follows:

| | lbs/hr |
|---|---|
| $CH_4$ | 331 |
| CO | 1,264 |
| $CO_2$ | 1,391 |
| $H_2$ | 97 |
| $H_2O$ | 806 |
| $C_2$+ | 164 |
| Other | 94 |
| Char Fines | 51 |
| Ash Fines | 222 |
| Total | 4,420 |

EXAMPLE 3

This example summarizes a calculated material balance for an integrated hydrogasification process using a bituminous coal feed in which air is directly added to the fluidized bed reactor. Process conditions are set forth in the example column in Table IV.

As before, coal is fed to the transfer line hydrogasifier at the rate of 2,000 pounds per hour and has the same ultimate analysis as shown in Example 1. Char at the rate of 18,600 pounds per hour is also fed to the base of transfer line hydrogasifier 11, where the char and the feed coal are suspended and entrained in synthesis gas introduced at the rate of 7,527 pounds per hour. The synthesis gas is supplied from the fluidized bed reactor 11, into which steam is fed at the rate of 1,688 pounds per hour and air is fed at the rate of 4,878 pounds per hour. The injected air contains 1,131 pounds per hour of oxygen, 3,682 pounds per hour of nitrogen and 65 pounds per hour of other constituents.

The synthesis gas fed to the base of the transfer line hydrogasifier 10 has the composition set forth in Table IV. The mass balance is as follows:

| | lbs/hr |
|---|---|
| $CH_4$ | 89 |
| CO | 1,005 |
| $CO_2$ | 1,614 |
| $H_2$ | 71 |
| $H_2O$ | 995 |
| $N_2$ | 3,682 |
| Other | 71 |
| Total | 7,527 |

The effluent from the transfer line hydrogasifier is passed into a gas-solid separation zone from which char is recovered and fed into the fluidized bed reactor at the rate of 19,561 pounds per hour. Product gas and fines are recovered overhead from the separator at the rate of 8,566 pounds per hour. This provides 3.071 million standard cubic feet per day of gas having a heating value of 159 Btu's per standard cubic foot. The product gas composition is shown in Table IV. The mass makeup of the product gas and fines is as follows:

| | lbs/hr |
|---|---|
| $CH_4$ | 225 |
| CO | 1,116 |
| $CO_2$ | 1722 |
| $H_2$ | 92 |
| $H_2O$ | 1,075 |
| $N_2$ | 3,702 |
| $C_2$+ | 227 |
| Other | 134 |
| Char Fines | 51 |
| Ash Fines | 222 |
| Total | 8,566 |

EXAMPLE 4

This example illustrates the rapid reaction of hydrogen with the carbon in fresh feed coal, and demonstrates the advantage of the transfer line hydrogasifier concept.

Free fall reactor studies were made to simulate reactions occurring in a transfer line hydrogasifier. The free fall reactor was an electrically heated steel chamber 8 feet in height and 3 inches in diameter. The reactor wall temperature was maintained at about 1600° F. and the reactor was pressurized with hydrogen. Wyodak subbituminous coal ground to 30 to 50 mesh size was dropped through the reactor, passing through the hydrogen and out of the reactor into an unheated catch pot. The coal heated up to about 1500° F. during passage and underwent devolatilization in the hydrogen atmosphere. The gaseous mixture was then withdrawn from the reactor and analyzed for methane and carbon oxides. The yields obtained, expressed as mols per 100 mols of carbon in the feed coal, are shown below in Table V. Conversion temperature in each instance was 1500° F.

TABLE V

| | Yields - Mols/100 Mols Carbon in Coal | | |
|---|---|---|---|
| Compounds | 20 psig 1 sec. coal Residence Time | 20 psig 2 sec. coal Residence Time | 55 psig 1.4 sec. coal Residence Time |
| $CH_4$ | 13.0 | 13.5 | 16.6 |
| CO | 8.3 | 8.5 | 8.1 |
| $CO_2$ | 1.9 | 2.0 | 1.7 |

It is seen that at 20 psig hydrogen pressure, very little additional conversion was obtained when coal residence time in the reactor was increased from about 1 to about 2 seconds, illustrating the rapid reactivity and convertibility of carbon in the feed coal. At the 55 psig hydrogen pressure, slightly greater coal conversions to methane were obtained in the free fall reactor. Because little added conversion is obtained with longer solids residence times, it is economically advantageous to conduct hydrogasification in a relatively inexpensive transfer line reactor in a highly effective hydrogen pressure than in a larger and far more expensive fluidized bed reactor.

The process of the invention has wide application. The preferred form of the invention employs a fluidized bed synthesis gas generation zone and the transfer line hydrogasifier. The low BTu gas produced by this process can be subjected to acid gas removal and particulate cleanup operations to provide a clean fuel suitable for the production of electric power. The use of the fluidized bed and transfer line reactors for producing methane-containing gases from coal permits construction in large sizes and leads to lower cost for the gaseous product than does the use of a multiplicity of small gravitating bed generators. For greater flexibility as applied to intermediate load and peak shaving types of power plant operation, as opposed to base load situation, the gaseous product made by the present process, after acid gas and particulate removal, can be passed, at least in part, to a Fischer-Tropsch or similar hydrocarbon synthesis step for total or partial conversion to liquid product. These liquid fuel products need not be high in quality because in many cases oxygenated or olefinic compounds will be suitable for power plant fuel. The production of a portion of the low Btu gas plant output as storable liquid fuel will greatly increase the flexibility of the system.

Sufficient flexibility can be achieved without the need for converting all of the product gas to liquids. For example, if 50% of the synthesis gas were converted to liquids under conditions of constant operation in both the gasification and synthesis steps, the net output could be reduced to 50% of normal by simply storing the liquid. In times of peak demand the liquids could be used to supply 200 to 300% or more of the normal demand. Even greater turndown of the output could be achieved by cutting back the operation of the gasification step. For example, with 50% of the gasifier product being converted to liquids, a 50% decrease in gasifier output would mean that there would be no gas product other than the purge from the synthesis step.

In summary, this invention, particularly in its preferred form, provides numerous advantages which are not provided by earlier processes, including a more economical reactor system which not only eliminates the unnecessarily long solids residence time of fluid bed hydrogasification reactors but is also simple and relatively easy to control and which permits use of conventional solids-handling concepts and construction materials requirements. In the preferred embodiment, steam, air or an oxidizing gas, and coal or a similar carbonaceous feed solid containing volatilizable hydrocarbonaceous matter are the only necessary reactants. Pure oxygen is not required, although it can be used. No second solid need be used as the reactant or as a catalyst. Electricity is not required for direct heating. Caking coals can be fed directly to the reactor system, avoiding the costs and yield losses associated with pretreating facilities necessary to eliminate the agglomerating tendencies of caking coals. Coal volatile matter contributes to the product gas, and methane is made by rapid hydrogasification of fresh coal outside the main fluidized bed gasification zone under higher effective hydrogen pressures. Heat for the fluid bed gasification zone is provided in a manner which maximizes process heat economy.

We claim:

1. A process for the production of a methane-containing gas from coal which comprises:

suspending hot solid particles and carbonaceous coal solids containing volatilizable hydrocarbon constituents in dilute phase in a gas stream containing hydrogen gas in a ratio of from about 3 to about 20 parts by weight of said particles per part of said solids, said particles having a temperature in excess of a minimum hydrogasification temperature of about 1200° F., said carbonaceous solids having a temperature below said minimum hydrogasification temperature, and said particles containing sufficient available heat to raise the temperature of said carbonaceous solids to at least said minimum hydrogasification temperature;

passing said gas stream containing said particles and said carbonaceous solids through a transfer line hydrogasifier at a pressure of from about 40 to about 1000 psia, the residence time of said carbonaceous solids in said hydrogasifier being limited to a period sufficient for the devolatilization of said carbonaceous solids and for the conversion of from one to about 50 mol percent of the carbon in said carbonaceous solids into methane; and withdrawing from said hydrogasifier a raw product gas containing methane produced within said hydrogasifier.

2. A process as defined by claim 1 wherein said gas stream comprises a synthesis gas containing hydrogen and carbon monoxide.

3. A process as defined by claim 1 wherein said particles comprise coal char.

4. A process as defined by claim 1 wherein the residence time of said carbonaceous solids in said transfer line hydrogasifier is between about 1 and about 20 seconds.

5. A process as defined by claim 1 wherein the superficial gas velocity in said transfer line hydrogasifier zone is between about 20 and about 100 feet per second.

6. A process as defined by claim 1 wherein said temperature of said particles is between about 1500° and about 2000° F.

7. A process as defined by claim 1 wherein said hydrogasification temperature is between about 1200° and about 1800° F.

8. A process as defined by claim 1 wherein the outlet pressure of said hydrogasifier is between about 40 and about 1000 psia, the superficial gas velocity in said hydrogasifier is between about 20 and about 100 feet per second, and said product gas is withdrawn from said hydrogasifier at a rate from about 15 to about 45 scf per pound of said carbonaceous solids containing volatilizable hydrocarbon constituents introduced into said hydrogasifier.

9. A process as defined by claim 1 wherein solids are withdrawn from said hydrogasifier with said product gas, the said withdrawn solids are separated from said product gas and introduced into a synthesis gas generation zone containing a fluidized bed of carbonaceous solids maintained at a temperature in excess of a minimum steam gasification temperature, steam is introduced into said synthesis gas generation zone to maintain said bed in the fluidized state and react with carbonaceous solids introduced into said bed, a synthesis gas containing hydrogen and carbon monoxide is withdrawn from said synthesis gas generation zone, and said synthesis gas is employed as said gas stream containing hydrogen gas in which said particles and said carbonaceous solids containing volatilizable hydrocarbon constituents are suspended.

10. A process as defined by claim 9 wherein said fluidized bed is maintained at a temperature between about 1500° and about 2000° F. and at a pressure between about 50 and about 1000 psia.

11. A process as defined by claim 9 wherein a stream of particles is continuously withdrawn from said fluidized bed in said synthesis gas generation zone at a temperature in excess of said hydrogasification temperature and said particles from said synthesis gas generation zone are employed as said hot solid particles which are suspended with said carbonaceous solids containing volatilizable hydrocarbon constituents in said synthesis gas.

12. A process as defined by claim 9 wherein said steam is introduced into the said synthesis gas generation zone at a rate of from about 0.3 to about 1.5 pounds of steam per pound of said carbonaceous solids containing volatilizable hydrocarbon constituents introduced into said hydrogasifier, the steam superficial velocity in said synthesis gas generation zone is from about 0.2 to about 2.0 feet per second, and said synthesis gas is withdrawn from said synthesis gas generation zone at a rate from about 10 to about 40 scf per pound of said carbonaceous solids containing volatilizable hydrocarbon constituents introduced into said hydrogasifier.

13. A process as defined by claim 9 wherein a stream of carbonaceous solids is continuously withdrawn from said synthesis gas generation zone and conducted to a combustion zone, said stream of solids is contacted in said combustion zone with an oxygen-containing gas, and solids are withdrawn from said combustion zone at a temperature in excess of said steam gasification temperature and returned to said synthesis gas generation zone.

14. A process as defined by claim 13 wherein said combustion zone is a transfer line burner and said oxygen-containing gas comprises air.

15. A process as defined by claim 14 wherein said stream of carbonaceous solids is introduced into said combustion zone at a temperature of from about 1500° to about 1900° F., said solids are withdrawn from said combustion zone at a temperature of from about 1650° to about 2100° F., said carbonaceous solids are withdrawn from said synthesis gas generation zone and introduced into said combustion zone at a rate of from about 5 to about 40 pounds per pound of carbonaceous solids containing volatilizable hydrocarbon constituents introduced into said hydrogasifier, said carbonaceous solids have a residence time in said combustion zone of from about 0.3 to about 5.0 seconds, said oxygen-containing gas has a superficial gas velocity in said combustion zone of from about 20 to about 100 feet per second, and said oxygen-containing gas is introduced into said combustion zone at a rate of from about 0.01 to about 0.45 pound per pound of carbonaceous solids introduced into said combustion zone.

16. A process as defined by claim 9 wherein molecular oxygen is introduced into said fluidized bed with the said steam to maintain said bed in the fluidized state.

17. A process as defined by claim 16 wherein the pressure in said synthesis gas generation zone is between about 50 and 1000 psia, steam is introduced into said synthesis gas generation zone at a rate of from about 0.3 to about 1.5 pounds per pound of carbonaceous solids containing volatilizable hydrocarbon constituents introduced into said hydrogasifier, oxygen is introduced into said synthesis gas generation zone at a rate of from about 0.2 to about 0.8 pound per pound of carbonaceous solids containing volatilizable hydrocarbon constituents introduced into said hydrogasifier, the steam-oxygen superficial velocity in said synthesis gas generation zone is from about 0.2 to about 2.0 feet per second, and synthesis gas is withdrawn from said synthesis gas generation zone at a rate of from about 15 to about 45 scf per pound of carbonaceous solids containing volatilizable hydrocarbon constituents introduced into said hydrogasifier.

18. A process as defined by claim 17 wherein the outlet pressure from said transfer line hydrogasifier is from about 40 to about 1000 psia, the gas superficial velocity in said hydrogasifier is between about 20 and about 100 feet per second, and said product gas is withdrawn from said hydrogasifier at a rate of from about 20 to about 55 scf per pound of carbonaceous solids containing volatilizable hydrocarbon constituents introduced into said hydrogasifier.

19. A process as defined by claim 9 wherein air is introduced into said fluidized bed with the said steam to maintain said bed in the fluidized state.

20. A process as defined by claim 19 wherein the pressure in said synthesis gas generation zone is between about 50 and about 1000 psia, steam is introduced into said synthesis gas generation zone at a rate of from about 0.3 to about 1.5 pounds per pound of carbonaceous solids containing volatilizable hydrocarbon constituents introduced into said hydrogasifier, air is introduced into said synthesis gas generation zone at a rate of about 1.0 to about 5.0 pounds per pound of carbonaceous solids containing volatilizable hydrocarbon constituents introduced into said hydrogasifier, the steam-air superficial velocity in said synthesis gas generation zone is from about 0.3 to about 3.0 feet per second, and synthesis gas is withdrawn from said synthesis gas generation zone at a rate of from about 35 to about 75 scf per pound of carbonaceous solids containing volatilizable hydrocarbon constituents introduced into said hydrogasifier.

21. A process as defined by claim 20 wherein the outlet pressure from said transfer line hydrogasifier is from about 40 to about 1000 psia, the gas superficial velocity in said hydrogasifier is between about 20 and about 100 feet per second, and said product gas is withdrawn from said hydrogasifier at a rate from about 45 to about 85 scf per pound of carbonaceous solids containing volatilizable hydrocarbon constituents introduced into said hydrogasifier.

22. A process as defined by claim 14 wherein fines are recovered from the flue gas from said transfer line burner, the recovered fines are contacted with an oxygen-containing gas to produce a hot effluent gas stream, and said hot effluent gas stream is injected into said transfer line burner.

23. A process as defined by claim 22 wherein said oxygen-containing gas contains oxygen in excess of the stoichiometric amount required for complete combustion of said fines and said hot effluent gas stream comprises from about 5 to about 20 mol percent molecular oxygen.

24. A process as defined by claim 22 wherein said fines are contacted with said oxygen-containing gas in the presence of injected steam and said hot effluent gas stream comprises a producer gas.

* * * * *